United States Patent [19]

Aoki

[11] Patent Number: 5,057,870

[45] Date of Patent: Oct. 15, 1991

[54] TONER DENSITY CONTROL DEVICE FOR AN IMAGE FORMING APPARATUS

[75] Inventor: Minoru Aoki, Kawasaki, Japan

[73] Assignee: Ricoh Company, Ltd., Tokyo, Japan

[21] Appl. No.: 472,802

[22] Filed: Jan. 31, 1990

Related U.S. Application Data

[63] Continuation-in-part of Ser. No. 344,960, Apr. 28, 1989, Pat. No. 4,980,726.

[30] Foreign Application Priority Data

May 2, 1988 [JP] Japan ..... 63-107545
Feb. 17, 1989 [JP] Japan ..... 1-36261

[51] Int. Cl.[5] ..... G03G 21/00

[52] U.S. Cl. ..... 355/246; 355/206; 355/209; 222/DIG. 1

[58] Field of Search ..... 355/245, 246, 203–206, 355/208, 209; 222/DIG. 1

[56] References Cited

U.S. PATENT DOCUMENTS 4,277,549 4/1981 Tatsumi et al. ..... 355/246 X
4,468,112 8/1984 Suzuki et al. ..... 355/246
4,607,933 8/1986 Haneda et al. ..... 355/246
4,707,114 11/1987 Aoki ..... 355/206

FOREIGN PATENT DOCUMENTS 0124358 7/1984 Japan ..... 355/246
0124359 7/1984 Japan ..... 355/246
0186280 8/1988 Japan ..... 355/246

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A toner density control device for an electrophotographic copier, facsimile apparatus, laser printer or similar image forming apparatus of the type forming an image by depositing a toner on an electrostatic latent image. The device has two sensing circuits, i.e., a toner density sensing circuit and an image density sensing circuit. When one of the two sensing circuits fails, a toner is supplemented in response to an output of the other or normal sensing circuit. When the failed sensing circuit is restored to normal, the toner supply responsive solely to the other sensing circuit is cancelled so that both of the two sensors join in the toner supply control. When both the toner density sensors and the image density sensing means fail, the image forming apparatus is automatically disabled with the failure being displayed.

7 Claims, 6 Drawing Sheets

TONER DENSITY CONTROL DEVICE FOR AN IMAGE FORMING APPARATUS

CROSS REFERENCE TO RELATED APPLICATION

This application is a continuation-in-part of copending patent application Ser. No. 07/344,960, filed Apr. 28, 1989 U.S. Pat. No. 4,980,726.

BACKGROUND OF THE INVENTION

The present invention relates to a toner density control device for an electrophotographic copier, facsimile apparatus, a laser printer or similar image forming apparatus of the type forming an image by depositing a toner on an electrostatic latent image.

Generally, an image forming apparatus of the type described uses a two-component developer which is a mixture of toner particles and carrier particles. The density of an image decreases as the toner content of the developer, i.e., the toner density decreases. It has been customary to form a test pattern on an image carrier in the form of a photoconductive element between images, to sense the image density of the test pattern, and feed a supplementary amount of toner automatically to the developer such that the sensed image pattern remains constant. This kind of implementation, however, has a drawback that once the image density is lowered due to the changes in the charge potential deposited on the photoconductive element, the amount of exposure, the characteristics of the developer and so forth due to aging, an excessive amount of toner is fed to bring about various problems such as excessively high image density, fog, and smear.

Japanese Patent Laid-Open Publication (Kokai) No. 57-136667 discloses a toner density control device which is elaborated to eliminate the above-discussed drawback. Specifically, the device disclosed in this Laid-Open Publication includes an image density sensor for optically sensing the density of a test pattern which is produced by a toner deposited on an electrostatic latent image, and a toner density sensor for sensing the density of a toner which constitutes a developer together with a carrier. The level for sensing the toner density is variable on the basis of the image density which is sensed by the image density sensor. Such a scheme, however, cannot be implemented without resorting to complicated control. Furthermore, when images each having a substantial area are formed, the distance between test patterns each intervening between the nearby images and, therefore, the interval between toner supply control timings is increased resulting in a difference in density being developed between the leading end and the trailing end of such a large image.

SUMMARY OF THE INVENTION

It is therefore an object of the present invention to provide a toner density control device for an image forming apparatus which maintains the image density constant despite the changes in the charge potential on a photoconductive element, the amount of exposure, characteristics of a developer and so forth due to aging.

It is another object of the present invention to provide a toner density control device for an image forming apparatus which prevents the image density from being changed with no regard to the size of an image to be formed.

It is another object of the present invention to provide a generally improved toner density control device for an image forming apparatus.

In accordance with the present invention, a toner density control device for an image forming apparatus in which a developing unit develops an electrostatic latent image on an image carrier by using a developer containing a toner comprises a toner density sensor for sensing a density of the toner contained in the developer, an image density sensor for optically sensing a density of a test pattern image produced by developing a latent image representative of a test pattern by the toner, a toner supplying device for supplying a predetermined amount of toner to the developing unit in response to at least one of the toner density and image density sensed by the toner density sensor and image density sensor, respectively, and a controller for controlling the toner supplying device such that in an image region which is spaced apart by a substantial distance from the test pattern and in which image density control using the image density sensor is not executed, the toner is supplied on the basis of an output of the toner density sensor having been produced while the image density control using the image density sensor has been executed.

Also, in accordance with the present invention, a toner density control device for an image forming apparatus in which a developing unit develops an electrostatic latent image on an image carrier by using a developer containing a toner comprises, a toner density sensor for sensing a density of the toner contained in the developer, an image density sensor for optically sensing a density of a test pattern image produced by developing a latent image representative of a test pattern by the toner, a toner supplying device for supplying a predetermined amount of toner to the developing unit in response to at least one of the toner density and image density sensed by the toner density sensor and image density sensor, respectively, and a controller for controlling the toner supplying device such that when either one of the toner density sensor and image density sensor fails, the toner is supplied in response to an output of the other sensor which is normal.

Further, in accordance with the present invention, a toner density control device for an image forming apparatus in which a developing unit develops an electrostatic latent image on an image carrier by using a developer containing a toner comprises at least one toner density sensor for sensing a density of the toner contained in the developer, at least one image density sensor for optically sensing a density of a test pattern image produced by developing a latent image representative of a test pattern by the toner, a toner supplying device for supplying a predetermined amount of toner to the developing unit in response to at least one of the toner density and image density sensed by the toner density sensor and image density sensor, respectively, and a controller for controlling the toner supplying device such that when a plurality of the toner density sensor and image density sensor fail, the image forming apparatus is automatically disabled.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
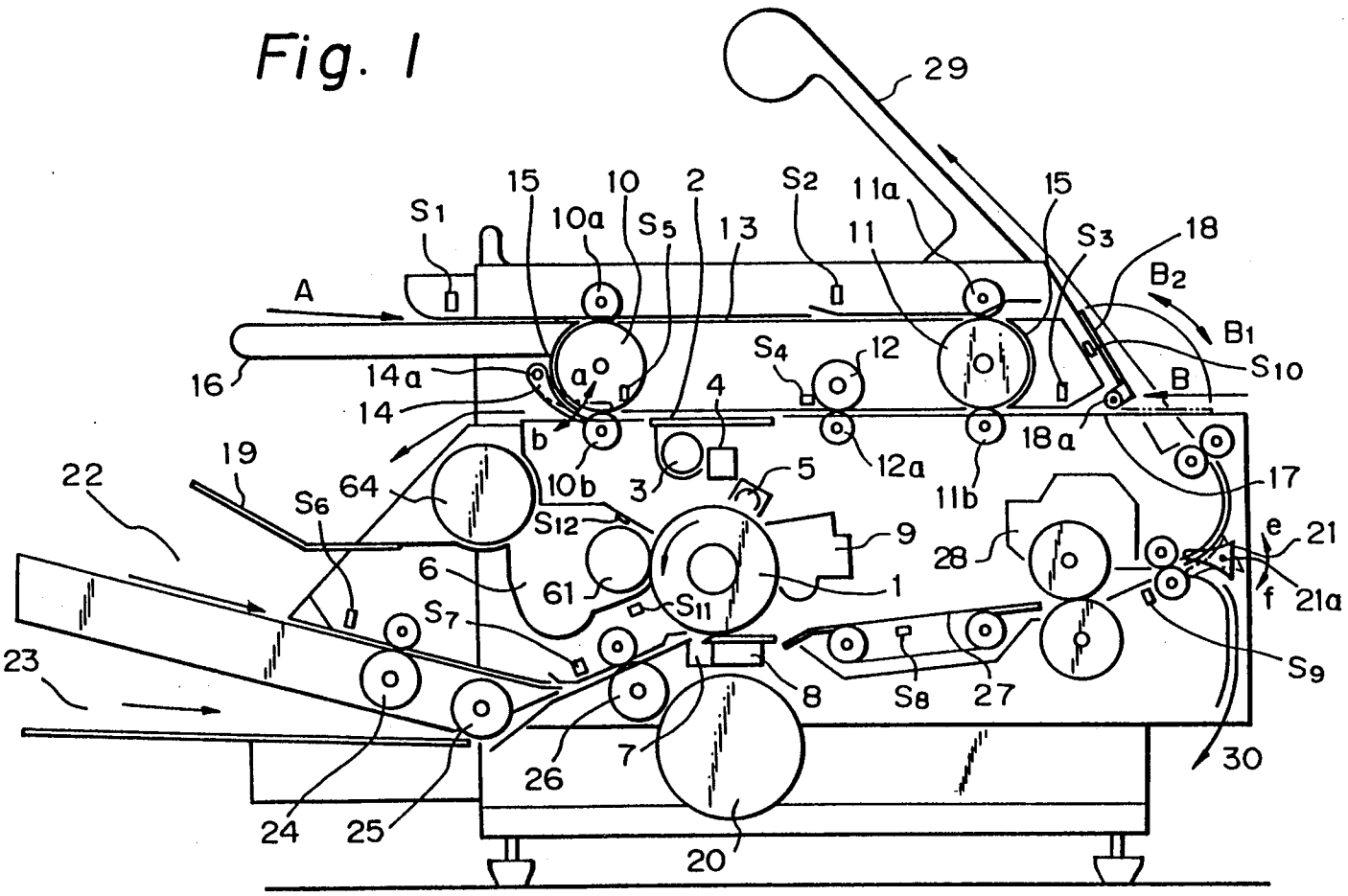
FIG. 1 is a view showing an electrophotographic copier to which the present invention is applicable.

Referring to FIG. 1 of the drawings, an electrophotographic copier to which the present invention is applicable is shown and includes a photoconductive drum 1. The drum is located in substantially the central part of the copier and rotatable as indicated by an arrow in the figure. While a document is transported on and along a glass platen 2 which constitutes an exposing section, a lamp 3 illuminates the document. A reflection from the document is focused onto the drum 1 by optics 4 such as a lens array. Arranged around the drum 1 are a main charger 5, a developing unit 6, a transfer charger 7, a separation charger 8, and a cleaning unit 9. Cyclic document transport means is disposed on the glass platen 2 for transporting a document in the form of a sheet on and along the glass platen 2. The document transport means is made up of a front drive roller 10 and driven rollers **10*a* and 10*b* disposed above and below the drive roller 10, a rear drive roller 11 and driven rollers 11*a* and 11*b* disposed above and below the drive roller 11, an intermediate drive roller 12 and a driven roller 12*a* located below the drive roller 12, a guide plate 13 interposed between the front drive roller 10 and the rear drive roller 11, a switching pawl rotatably 14 supported by a shaft 14*a* at one end thereof and movable between two positions a and b for switching over a document transport path between the front drive roller 10 and the driven roller 10*b*, and guide plates 15 each being associated respective one of the front and rear drive rollers 10 and 11** for guiding the document to the latter.

A document table 16 is provided in front of the document transport means and at the same level as the top of the front drive roller 10, a document being laid on the table 16 face up. A first document inserting section A allows the document laid on the table 16 to be inserted between the drive roller 10 and the driven roller **10*a*. A second document inserting section B is provided at the rear of the document transport means for allowing a document to be fed to between the rear transport roller and the driven roller 11*a*. A flat insertion guide 18 is rotatable about a shaft 18*a* on the top 17 of the machine frame. Specifically, the insertion guide 18 is movable between two different positions: a position indicated by a solid line and in which it abuts against a copy receiving plate 29 for preventing a document from being inserted, and a horizontal position indicated by a phantom line and in which it is substantially flush with the top 17 of the machine frame. When the insertion guide 18 is rotated clockwise about the shaft 18*a* to the horizontal position as indicated by an arrow $B_1$, it allows a document to be fed into the second document inserting section B. A document fed through any of the first and second inserting sections A and B is discharged onto a document tray 19** upon completion of a copying operation.

Sensors $S_1$ and $S_2$ are positioned in the first and second document inserting sections A and B, respectively. When a document is fed through any of the inserting sections A and B, the associated sensor $S_1$ or $S_2$ energizes a drive motor 20 and turns on a lamp 3 while starting to rotate the front and rear drive rollers 10 and 11. A sensor $S_2$ is provided for sensing a sheet jam. A sensor $S_4$ is a document register sensor. When the sensor $S_4$ senses the leading edge of a document, the drive of the document is interrupted for a moment. A sensor $S_5$ is associated with a repeat mode. Specifically, when a repeat mode operation is selected, the switching pawl 14 is changed over from the position a to the position b as soon as the sensor $S_5$ senses the leading edge of a document. A sensor $S_{10}$ is controlled by the insertion guide 18. When the insertion guide 18 is in the position indicated by a solid line, a discharge switching pawl 21 which will be described is actuated by an output of the sensor $S_{10}$. When the insertion guide 18 is rotated to the horizontal position as indicated by a phantom line, document insertion inhibiting means (not shown) located in the first document inserting section A is operated by an output of the sensor $S_{10}$ so that a document may be inserted only through the second inserting section B. The insertion inhibiting means may be implemented by an exclusive member for closing the inlet of the first inserting section A or the sensor $S_1$ itself which has a lever portion that can be locked in position.

Hereinafter will be described means for feeding, transporting and discharging a paper sheet as distinguished from a document sheet.

A manual paper feeding section 22 and an automatic paper feeding section 23 are provided on the front end of the machine. In a manual insertion mode, a paper sheet is driven by a feed roller 24 toward a register roller 26. Likewise, in an automatic insertion mode, it is driven by a feed roller 25 toward the register roller 26. The register roller 26 brings the paper sheet into register with a document. In an image transfer station, toner particles deposited on the drum 1 are transferred to the paper sheet by the transfer charger 7. Then, the paper sheet is separated from the drum 1 by the separation charger 8 and further transported by a belt 27 to a fixing unit 28. The paper sheet coming out of the fixing unit 28 is directed by the discharge switching pawl 21 to either one of the copy receiving plate, or upper discharging section, and a lower discharging section 30. The pawl 21 is rotatable about a shaft **21*a*. When the pawl 21 is rotated counterclockwise as indicated by an arrow e, it communicates the paper transport path to the upper discharging section 29; when the pawl 21 is rotated clockwise as indicated by an arrow f, it communicates the paper transport path to the lower discharging section 30. An operation board (not shown) is provided with discharging section switchover sensor so that, when a document is inserted through the first inserting section A, either one of the upper and lower discharging sections 29 and 30 may be selected in response to the output of the sensor. On the other hand, when a document is to be fed through the second inserting section B, the insertion guide 18 forming a part of the section B is rotated to the horizontal position in the direction $B_1$ and, hence, the path terminating at the upper discharging section 29 is blocked by the insertion guide 18. At the same time, the switching pawl 21 is actuated by an output of the sensor $S_{10}$ to bring the paper transport path into connection with the lower discharging section 30. In this instance, a display provided on the operation board shows that the lower discharging section 30** is to be used and thereby inhibits the discharge changeover sensor from being manipulated.

A sensor $S_6$ is operated by a paper sheet which is inserted into the manual feeding section 23. The sensor $S_6$, like the sensors $S_1$ and $S_3$, drives the motor 20 which is adapted to transport a paper sheet and a document. A register sensor $S_7$ is responsive to the leading edge of a paper sheet. Upon sensing the leading edge of a paper sheet, the register sensor $S_7$ temporarily stops the rotation of the feed roller 24 and the rotation of the register roller 26 for causing the paper sheet into register with a document, the paper sheet being refed timed to the refeed of the document. Sensors $S_8$ and $S_9$ are associated respectively with the transport belt 27 and the paper transport path between the fixing unit 28 and the pawl 21, and each functions to sense a paper jam.

An ordinary document sheet may be fed through the first document inserting section A for producing a single copy in a single copy mode or producing a plurality of copies in a repeat copy mode, as desired. Assume that one desires to produce a single copy by feeding a document through the first inserting section A and by feeding a paper sheet by hand. Then, the operator loads a paper sheet in the manual feeding section 22. On the other hand, when the operator selects an automatic paper feed mode in combination with the first document inserting section A, the operator checks the automatic feeding section 23. Thereupon, the operator lays a desired document on the document table face up and then inserts it into the first inserting section A. In response to the resulting output of the sensor $S_1$ or $S_6$, the motor 20 is energized to drive the document transport rollers and thereby the document. As the document reaches the register sensor $S_4$, a clutch (not shown) associated with the document transport path is uncoupled by the output of the sensor $S_4$ so as to interrupt the transport of the document. Likewise, the paper sheet fed from either one of the feeding sections 22 and 23 is temporarily stopped as soon as a clutch (not shown) associated with the paper transport path is uncoupled by the output of the register sensor $S_7$. This causes the document and the paper sheet into register with each other. The document refed after such a temporary stop is moved away from an imagewise exposing station toward the document tray 19 without being steered by the switching pawl 14. The paper sheet to which a toner image has been transferred from the drum 1 by the transfer charger 7 is separated from the drum 1 by the separation charger 8 and then driven to the fixing unit 28 by the belt 27.

When the first document inserting section A is selected, the insertion guide 18 in the second document inserting section B is held in the position where it abuts against the upper discharging section or upper tray 29. In this condition, the insertion guide 18 sets up a path which terminates at the upper tray 29. Hence, the paper sheet or copy can be discharged to any one of the lower discharging section 30 and the upper discharging section 29, as desired. Specifically, when either one of the discharging sections 29 and 30 is selected on the operation board, the switching pawl 21 is rotated about the shaft 21*a* either in the direction $_e$ or in the direction f. The pawl 21 guides the paper sheet toward the upper discharging section 29 via the second inserting section B when rotated in the direction e, while guiding it toward the lower discharging section 30 when rotated in the direction f.

In a repeat mode to be effected with the first inserting section A, a desired number of copies is entered on the operation board, and then a document is fed through the first inserting section A. As the sensor $S_5$ senses the leading edge of the document which has moved away from the exposing station, drive means (not shown) rotates the switching pawl 14 away from the drive roller 10 as indicated by the arrow b in response to the output of the sensor $S_5$. As a result, the document is guided by the switching pawl 14 to be refed by the drive roller 10. After the document has been repetitively transported through the exposing station by the desired number of times, the switching pawl 14 is rotated in the direction a resulting in the document being discharged onto the document tray 19. In this case, paper sheets are sequentially fed from the manual feeding section 22 or the automatic feeding section 23 until the desired number of copies have been produced.

Concerning the cyclic transport of a document, the resistance exerted by transport rollers which steer a document increases depending upon the kind of the document, e.g., when it has a substantial thickness or a substantial degree of elasticity. Such a resistance is apt to cause incomplete transport and, in the case of a document having some cut pieces of sheet adhered thereto, to tear them off. In the illustrative embodiment, the second inserting section B which does not have any curved steering portion is capable of feeding even the above-mentioned kind of document without any trouble. To use the second inserting section B, the insertion guide 18 is rotated away from the upper discharging section to the horizontal position as indicated by the arrow $B_1$, becoming ready to receive a document. Upon the rotation of the insertion guide 18, the insertion of a document through the first inserting section A is inhibited by the output of the sensor $S_{10}$. Hence, documents are prevented from being fed at the same time through the first and second inserting sections A and B. Due to the horizontal position of the insertion guide 18, it is impossible to discharge a paper sheet to the upper discharging section 29 and, therefore, the drive means (not shown) is actuated by the output of the sensor $S_{10}$ to rotate the pawl 21 in the direction f. In this condition, a paper sheet is discharged to the lower discharging section 30 by the pawl 21.

Figure 2:
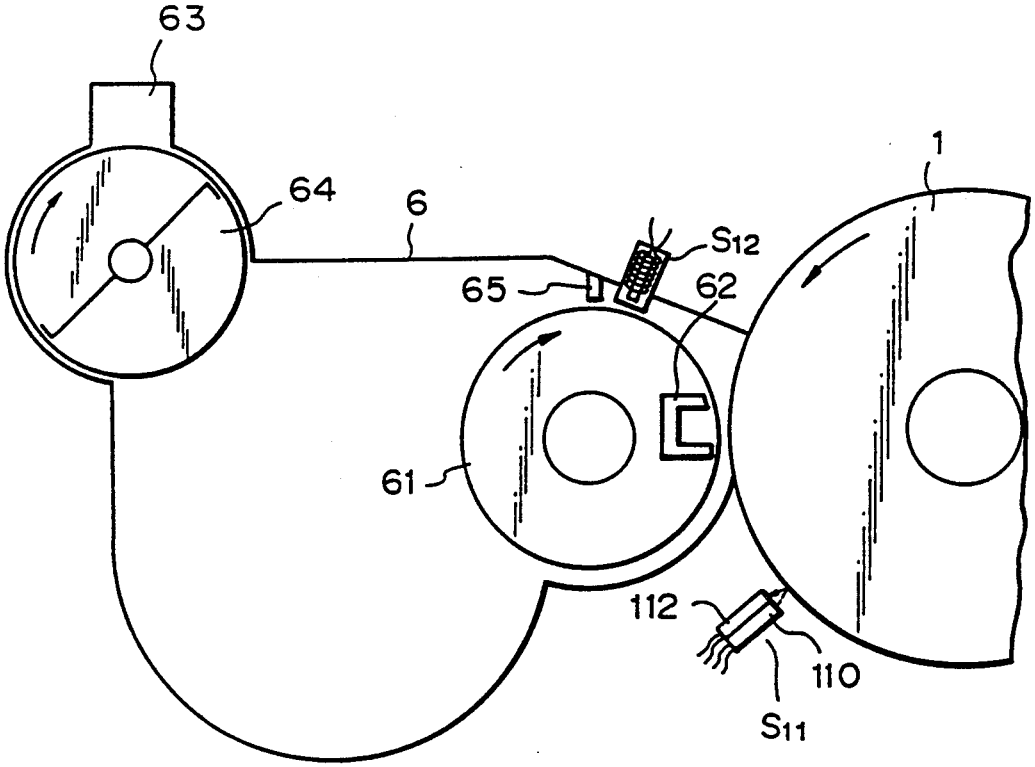
FIG. 2 is a view schematically showing a photoconductive drum installed in the copier of FIG. 1 and an essential part of a developing unit which is relevant to the present invention.

An image density sensor $S_{11}$ is located to face the drum 1 shown in FIG. 1, while a toner density sensor $S_{12}$ is mounted on the developing unit 6. The sensors $S_{11}$ and $S_{12}$ constitute respectively a sensing section of an image density sensing device and a sensing section of a toner density sensing device of the illustrative embodiment. FIG. 2 schematically shows the drum 1 and an essential part of the developing unit 6 which is relevant to the present invention, inclusive of the sensors $S_{11}$ and $S_{12}$. As shown, the image density sensor $S_{11}$ is made up of a photodiode 110 and a phototransistor 112 and responsive to a test pattern which intervenes between image patterns formed on the drum 1. Specifically, a magnet brush formed on a developing sleeve 61 of the developing unit 6 by a magnet 62 deposits a toner on the latent image of the test pattern. Light issuing from the photodiode 110 is reflected by the developed test pattern to become incident to the phototransistor 112, so that the density of the image formed on the drum 1 is determined in terms of the amount of light incident to the phototransistor 112. The toner image density sensor $S_{12}$ is implemented by a magnetic core and three windings which are wound around the core, as described in detail later with reference to FIG. 3. The sensor $S_{12}$ senses a toner image density in terms of the magnetic resistance of the developer, i.e., magnetic permeability, based on the fact that the permeability is small when the content of toner which is non-magnetic is greater than that of the carrier which is magnetic and is large if otherwise.

In detail, the developing unit 6 has a toner supplying mechanism 64 for supplying by each predetermined amount a toner which is stored in a toner stocker 63. The developer which is a mixture of toner and carrier particles is transported by the constantly rotating developing sleeve 61 while being regulated by a doctor blade 65 to a substantially uniform thickness. When the regulated layer of toner reaches the toner density sensor $S_{12}$, its density is measured.

Figure 3:
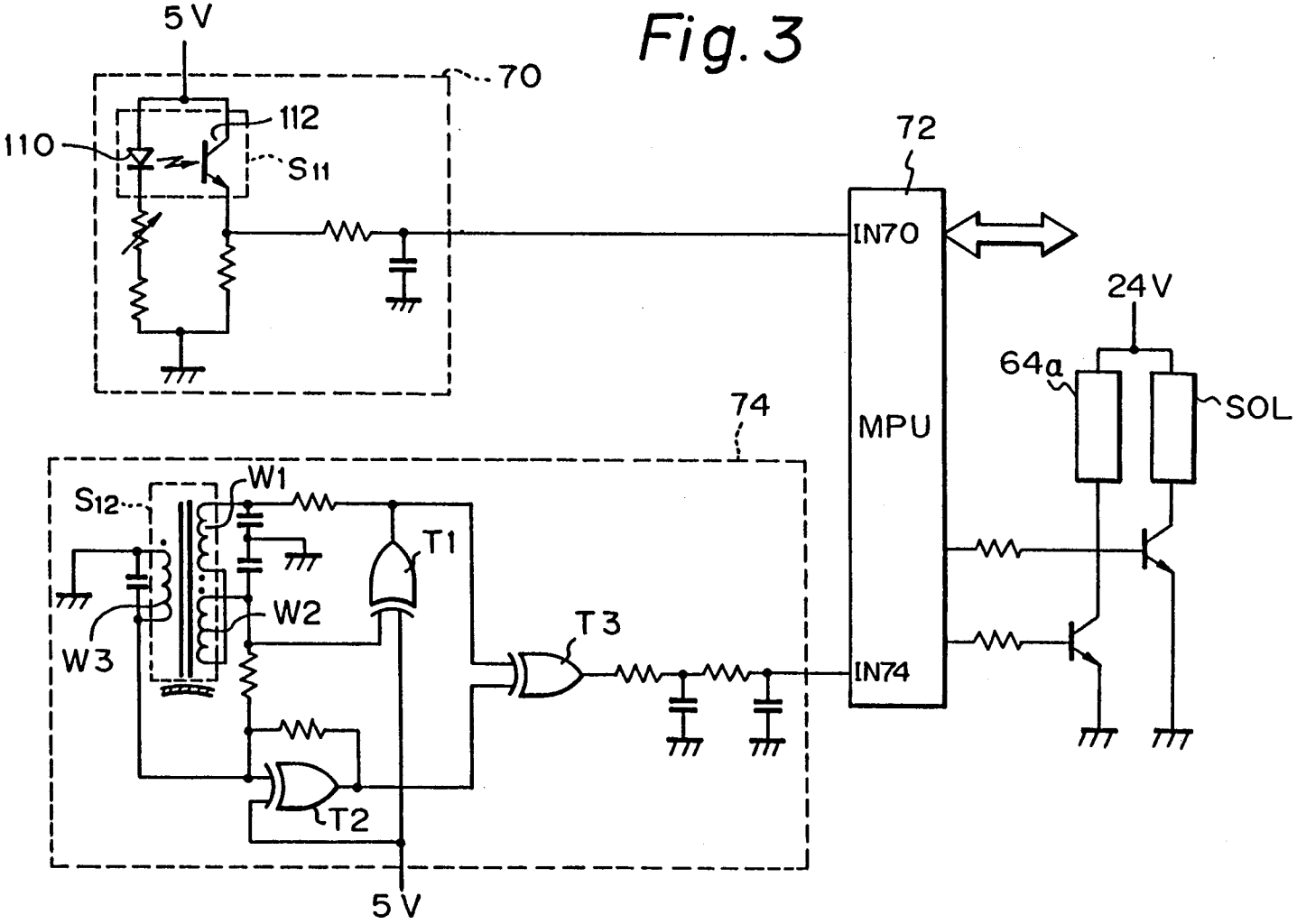
FIG. 3 is a circuit diagram showing a specific construction of a control circuit which implements a toner density control device embodying the present invention.

Referring to FIG. 3, an electric circuit for implementing the toner density control device embodying the present invention is shown. As shown, the image density sensing device, generally 70, includes the sensor $S_{11}$ which is made up of the photodiode 110 and phototransistor 112. As previously mentioned, light from the photodiode 110 is incident to a test pattern which is formed on the drum 1 by, for example, screening a reflection from the document surface by an exclusive solenoid SOL. A reflection from the test pattern is incident to and photoelectrically converted by the phototransistor 112. The output of the phototransistor 112 is routed to an analog input port IN70 of a microcomputer 72 via a smoothing circuit made up of a resistor and a capacitor. The toner density sensing device, generally 74, includes the sensor $S_{12}$ having three windings W1 to W3, and three Exclusive-OR (Ex-OR) gates $T_1$, $T_2$ and $T_3$. The Ex-OR gate $T_1$ constitute an oscillation circuit in cooperation with the windings W1 and W2. The output of the third winding W3 which varies with the toner content of the developer is inverted and amplified by the Ex-OR gate $T_2$ and then compared with the output of the Ex-OR gate $T_3$ by the Ex-OR gate $T_2$. The smoothed output of the toner density sensing device 74 is fed to an analog input port IN74 of the mirocomputer 72. When the microcomputer 72 determines that the toner content or density in the developer is short on the basis of the output of the toner density sensing device 74, it couples a clutch 64*a* included in the mechanism 64. As a result, the mechanism 64 is rotated to feed a supplementary amount of toner from the toner stocker 63 to the developing unit 6.

The amount of toner consumption is dependent upon the density and area of an image. If the density of an image is high, the toner density is sharply lowered with the result that the density of the test pattern provided between document images on the drum 1 is lowered. This causes the output signal of the image density sensing device 70 to vary, e.g., increase. In response, the microcomputer 72 increases the period of time during which the toner supply clutch 64*a* remains coupled, thereby increasing the amount of toner supply. Specifically, the period of time t during which the clutch 64*a* remains coupled is determined by:

$$t = K \times \text{toner supply level} \times \text{supply ratio level} \times \text{document level}$$

where K is a proportional constant which depends upon the processing conditions. The words "toner supply level" has any of values which are shown in Table 1 below. The words "supply ratio level" and "document level" will become clear from the following description.

TABLE 1

| OUTPUT OF IMAGE DENSITY SENSE SECTION 70 | NUMBER OF TIMES OF SENSING 1ST MODE | 1ST TONER SUPPLY LEVEL | 5TH MODE | 5TH TONER SUPPLY LEVEL |
|---|---|---|---|---|
| (LIGHT) | normal | 4 | error | 0 |
| 2.5 V | normal | 4 | exhausted | — |
| 0.9 V | normal | 4 | normal | 4 |
| 0.7 V | normal | 2 | normal | 2 |
| 0.6 V | normal | 1 | normal | 1 |
| 0.5 V | normal | 0 | error | 0 |
| (DARK) Vsg ≦2.5 V | normal | 0 | error | 0 |

The specific outputs of the image density sensing device 70 shown in Table 1 are determined on the assumption that the output voltage Vsg of the device 70 associated with a condition wherein no toner is deposited on the drum 1, i.e., a reference output volage is 4 volts. For example, assume that the output voltage Vsp of the device 70 is 2.5 volts due to the low density of a test pattern which is formed on the drum 1, and that the test pattern density is measured five consecutive times. Then, a toner supply of level 4 is executed in response to the result of the first measurement by determining that the test pattern density is normal, but error processing is executed when the output voltage of 2.5 volts continues up to the fifth measurement. When the output voltage of the device 70 is higher than 0.5 volt and lower than 2.5 volts, a display is produced for urging one to supply a toner to the toner stocker 63 by determining that the toner has run out.

Figure 4:
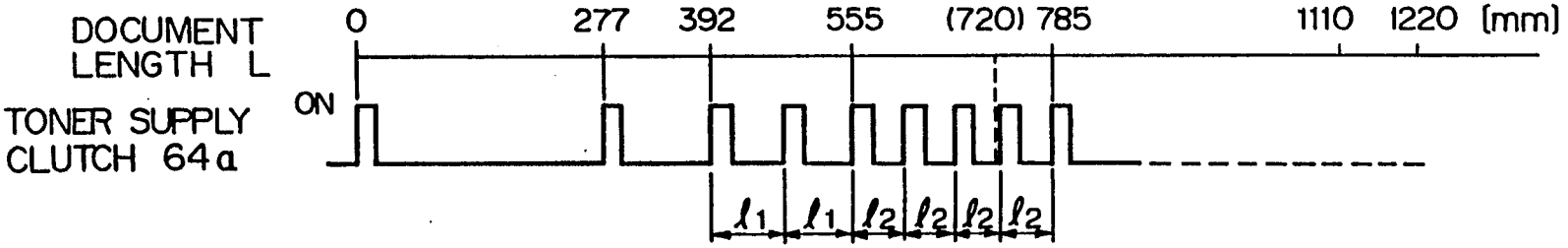
FIG. 4 is a diagram showing a relationship between the length of a document and the toner supply.

The toner supply level is defined as an index of the amount of toner to be supplied to the developing unit 6 by the toner supplying mechanism 64 and, more specifically, an index of a period of time during which the clutch 64*a* is coupled under the control of the microcomputer 72 to drive the mechanism 64. As shown in FIG. 4 which will be described, when a single toner supply is effected by a predetermined duration of coupling of the clutch 64*a*, the toner supply level is of course the index which determines the number of times that the clutch 64*a* should be coupled. On the other hand, the supply ratio level is defined as an index of the amount of toner supplemented by a single supply and may be selected as shown in Table 2 below.

TABLE 2

| SUPPLY RATIO (%) | SUPPLY LEVEL |
|---|---|
| 7 | 1 |
| 15 | 2 |
| 30 | 4 |
| 60 | 8 |

A problem is that since the test pattern is formed between the images on the drum 1, the output signal of the image density sensing device 70 is interrupted while a single image is formed. On the other hand, since the printing area is substantially proportional to the square of the length of a side of a document, the amount of toner consumption also increases substantially in proportion to the square of the length of a side of a document. Hence, when an image formed on the drum 1 has a substantial area, the density is sequentially lowered within the single image. The illustrative embodiment overcomes this problem by sensing the length of a document by using the register sensor $S_4$ (FIG. 1), and selecting a particular document level in matching relation to the length of the document, as shown in Table 3 below

TABLE 3

| DOCUMENT LENGTH L (mm) | NUMBER OF SUPPLIES | PAPER SIZE |
|---|---|---|
| $0 < L \leqq 277$ | 1 | B4 LATERAL |
| $277 < L \leqq 392$ | 2 | A4, B4 LONGITUDINAL<br>A3, B3 LATERAL |
| $392 < L \leqq 555$ | 4 MAX | A3, B3 LONGITUDINAL<br>A2, B2 LATERAL |
| $555 < L \leqq 785$ | 8 MAX | A2, B2 LONGITUDINAL<br>A1, B1 LATERAL |
| $785 < L \leqq 1110$ | 16 MAX | A1, B1 LONGITUDINAL |
| $1110 < L \leqq 1220$ | 20 MAX | A0 LONGITUDINAL<br>irregular |
| $1220 < L$ | responsive to toner supply sensor output | irregular |

Referring to FIG. 4, specific operations for supplying a toner as indicated in Table 3 are shown. Under the control of the microcomputer 72, the toner supply clutch 64*a* (FIG. 3) is coupled for a predetermined period of time as represented by a high level at each of the document lengths L of 0 millimeter, 277 millimeters, 392 millimeters, the bisecting point between 392 millimeters and 555 millimeters, the quadrisecting points between 555 millimeters and 784 millimeters, the octasecting points between 785 millimeters and 1110 millimeters, and the quadrisecting points between 1110 millimeters and 1220 millimeters, whereby a predetermined amount of toner is supplied. For example, when the length L is associated with the bisecting point between 392 millimeters and 555 millimeters, the clutch 64*a* is coupled for a predetermined period of time at an interval of $l_2$. Likewise, for the length L associated with the quadrisecting points between the 555 millimeters and 785 millimeters, the clutch 64*a* is coupled at an interval of $l_2$. In table 3, the number of times that a toner is supplied is indicated by a maximum value for each of the document lengths greater than 392 millimeters. This is to end the toner supply when the document length is 720 millimeters, for example, as soon as the register sensor $S_4$ senses the trailing edge of the document, as indicated by a parenthesis in FIG. 4. More specifically, an arrangement may be made such that when the leading edge of a document is sensed, the toner is supplied at the predetermined timing or timings shown in FIG. 4 with no regard to the length of the document and, when the trailing edge of the document is sensed, the toner supply is ended.

Concerning a document which is longer than 1220 millimeters, the supply of toner controlled by the toner density sensing device 74 (FIG. 3), i.e., the toner supply relying on the toner density only, is executed after the above-mentioned twenty times of toner supply which is based on the image density.

Figure 5:
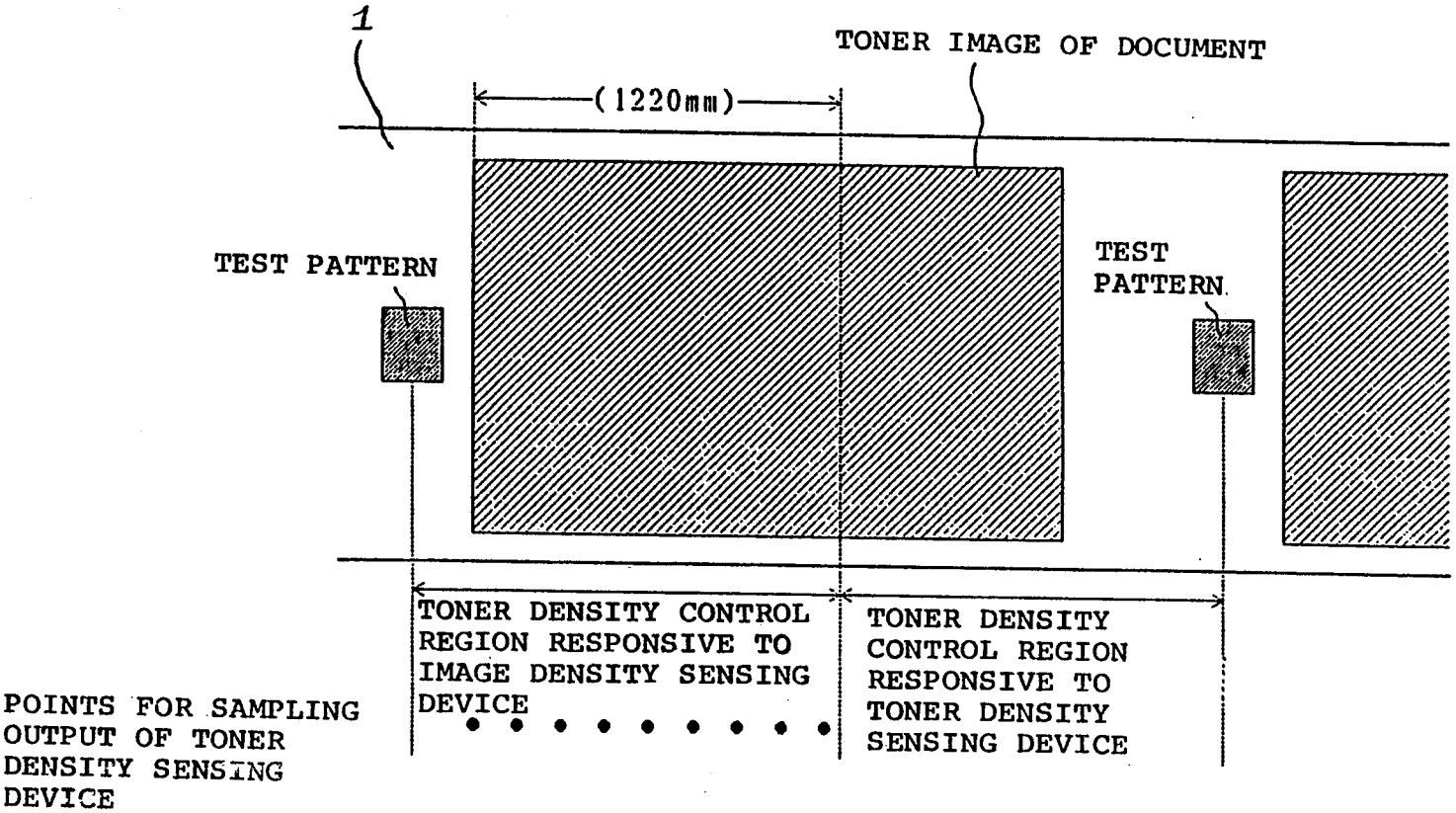
FIG. 5 shows a tonr image formed on a photoconductive drum and toner supply control.

Specifically, FIG. 5 shows a toner image (developed image) formed on the drum 1 in a plan view. As shown, in the first region where the toner density is controlled on the basis of an output of the image density sensing device 70, i.e., the first region dimensioned 1220 millimeters in this specific example, the output of the toner density sensing device 74 is sampled as represented by dots in the figure. The clutch 64*a* is coupled and uncoupled by using a mean value of the sampled outputs as a threshold, whereby the toner is supplied in such a manner as to maintain the toner density constant. The mean value of the sampled outputs is cleared when the next test pattern is detected.

In the specific procedure described above with reference to FIG. 5, in the second region wherein the toner density is controlled by the output of the toner density sensing device 74, it is maintained equal to the toner density which was set up by the output of the image density sensing device. More specifically, the toner density is maintained constant even when the control relies on the output of the toner density sensing device 74 only. The resulting image is, therefore, far more desirable than an image available with a prior art device which controls the toner density to a fixed value with no regard to the condition of an image. If desired, the toner supply may be effected on the basis of the length of a paper sheet in place of the size of a document, paper sizes being shown in the rightmost column of Table 3 which are available for practicing such alternative toner supply.

The length of a paper sheet may of course be determined by using the sensor $S_7$ which is responsive to the leading edge of a paper sheet, as shown in FIG. 1.

The toner supply level, supply ratio level and document level as defined above are used to calculate the duration t of coupling of the clutch 64*a* on the basis of the previously mentioned equation. However, when the toner content in the developer is greater than a predetermined value as sensed by the toner density sensing device 74, the output of the microcomputer for coupling the clutch 64*a* is interrupted to stop the toner supply. This is successful in preventing an excessive amount of toner which would bring about fog and the like from being fed to the developing unit 6. Conversely, when the toner content in the developing unit 6 is smaller than the predetermined content, the microcomputer 72 produces the output for coupling the clutch 64*a* in response to an output of the device 74 so as to supply the toner with no regard to the toner supply which is associated with the image density sensing device 70.

Table 4 shown below lists specific output voltages of the toner density sensing device 74 and operations associated therewith.

TABLE 4

| OUTPUT VOLTAGE [V] OF SENSING DEVICE 74 | OPERATION |
|---|---|
| $V_{TS} > 3.5$ | DETERMINED NORMAL IF CONTINUED 20 SEC |
| $3.5 \geqq V_{TS} > 1.7$ | TONER SUPPLY CLUTCH ON |
| $1.7 \geqq V_{TS} > 0.9$ | TONER SUPPLY CLUTCH OFF |
| $V_{TS} \leqq 0.9$ | DETERMINED FAULTY IF CONTINUED 20 SEC |

As shown in Table 4, while the toner density lies in a usual range, the output voltage Vts of the toner density sensing device 74 is lower than 1.7 volts and higher than 0.9 volt. However, as the toner density decreases, the output voltage of the toner density sensing device 74 increases and, on exceeding 1.7 volts, couples the toner supply clutch 64*a*. Consequently, the toner is fed from the toner stocker $6_1$ to maintain the toner density in the developing device 6 constant. It is to be noted that when the output voltage Vts of the toner sensing device 74 remains higher than 3.5 volts or lower than 0.9 volt for more than 20 seconds, the toner density sensing device 74 is determined to be faulty.

In the illustrative embodiment having two sensing devices, i.e., toner density sensing device 70 and image density sensing device 74, a toner can be supplied without any trouble when any one of the two sensing devices fails, by using an output of the other sensing device. The copier can therefore be operated without interruption even under such a condition. Preferably, an arrangement is made such that when the failed sensing device is restored to normal, the toner supply relying solely on the output of the other sensing device is cancelled and, instead, the usual operating condition using both of the two sensing devices is reestablished.

Further, two or more toner density sensing devices 74 and two or more image density sensing devices 70 may be used in combination. Then, when two or more of such devices 74 and 70 fail, continuing the copying procedure or similar image forming procedure would result in wasteful copies or would, in the worst case, damage the machine itself. In the illustrative embodiment, when error occurs in two or more of the sensing devices, the error may be displayed for alerting purpose or the machine may be automatically deactivated. Concerning the image density sensing device 70, for example, it may be determined as being faulty when the output voltage Vsg of the image density sensing device 70 remains higher than 2.5 volts or lower than 0.5 volt throughout the first to fifth measurements, e.g., throughout the period of 20 seconds, as stated in relation to Table 1 earlier, or when the output voltage Vsg is equal to or lower than 2.5 volts despite that no toner is deposited on the drum 1. Concerning the toner density sensing device 74, it may be determined as being faulty when its output voltage Vts remains higher than 3.5 volts or lower than 0.9 volt for more than 20 seconds, as described in relation to Table 4.

Figure 6A:
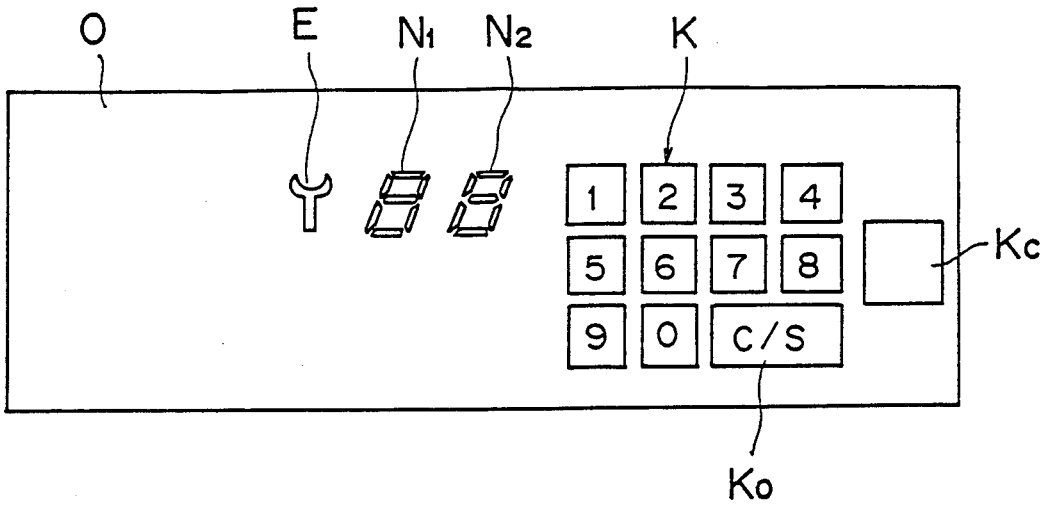
FIGS. 6A and 6B shows a specific configuration of an operation board of an electrophotographic copier.
Figure 6B:
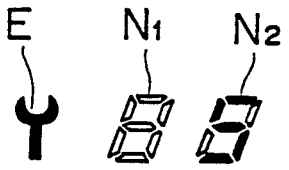

FIG. 6A shows a specific configuration of an operation board O for alerting one to the failure of a pluality of sensing devices as stated above. As shown, the operation board O has an error display element E and two seven-segment numerical display elements $N_1$ and $N_2$. When the microprocessor 72 determines that a plurality of sensing devices have failed on the basis of their outputs, the error display element E glows to indicate the occurence of the failure while the numerical display elements $N_1$ and $N_2$ show the content of the failure. For example, FIG. 6B indicates a condition wherein the error display element E shows the occurence of error and the numerical display elements $N_1$ and $N_2$ show numeral "5" representative of the failure of a plurality of particular sensing devices. Of course, the configuration of the error display element E and the numeral indicative of the content of error shown in FIGS. 6A and 6B are only illustrative and may be replaced with any other configuration and numeral. In FIG. 6A, the operation board 6A is further provided with numeral keys K for entering a desired number of copies, a clear/-stop key $K_o$ for cleaning entered states or stopping the operation of the machine, and a copy key $K_c$ for executing a copying operation, for example. The alphanumeric characters or similar symbols representative of errors as stated above will promote rapid repair by indicating the specific locations where errors have occurred.

Alternatively, when all the sensing devices have failed as described above, the operation of the machine may be automatically stopped to eliminate poor copies and the scattering of excessive toner.

It will be seen that the error display or the automatic deactivation of the machine stated above is also practicable when either one of the tonr density sensing device 74 and image density sensing device 70 is implemented as a plurality of sensing devices, for the purpose of enhancing the reliability of operation.

In summary, in accordance with the present invention, the toner density is controlled by a toner density sensing device and an image density sensing device so that not only an adequate image density is insured but also images are free from fog, smear, etc. Another advantage attainable with the present invention is the toner supply condition is varied in association with the length of a document or that of a paper sheet, eliminating a change in the image density even in an image having a substantial area. When the toner density sensing device and/or the image density sensing device fails, it is possible to display the occurrence and content of the failure or to stop the operation of the machine automatically. This is successful in eliminating poor or wasteful copies while safeguarding the machine against damage.

Various modifications will become possible for those skilled in the art after receiving the teachings of the present disclosure without departing from the scope thereof.

What is claimed is:

1. A toner density control device for an image forming apparatus in which developing means develops an electrostatic latent image on an image carrier by using a developer containing a toner, said device comprising:

toner density sensing means for sensing a density of the toner contained in the developer;

image density sensing means for optically sensing a density of a test pattern image produced by developing a latent image representative of a test pattern by the toner;

toner supplying means for supplying a predetermined amount of toner to the developing means in response to at least one of a toner density and an image density sensed by said toner density sensing means and said image density sensing means, respectively; and control means for controlling said toner supplying means such that in a first image region image density is controlled using said image density sensing means, and in a second image region which is spaced apart by a substantial distance from said test pattern image density is controlled using said toner density sensing means, wherein in said second image region the toner is supplied on the basis of a toner density signal produced during the image density control in the first image region using said image density sensing means .

2. A device as claimed in claim 1, wherein said control means controls said toner supplying means such that the toner is supplied on the basis of a result of comparison of an output of said toner density sensing means with a threshold value which is a mean value produced by sampling an output of said toner density sensing means while said image density control using said image density sensing means is under way.

3. A toner density control device for an image forming apparatus in which developing means develops an electrostatic latent image on an image carrier by using a developer containing a toner, said device comprising:

toner density sensing means for sensing a density of the toner contained in the developer;

image density sensing means for optically sensing a density of a test pattern image produced by developing a latent image representative of a test pattern by the toner;

toner supplying means for supplying a predetermined amount of toner to the developing means in response to at least one of a toner density and an image density sensed by said toner density sensing means and said image density sensing means, respectively; and control means for controlling said toner supplying means such that when said toner density sensing means fails, the toner is supplied in response to an output of said image density means, and when said image density sensing means fails, the toner is supplied in response to an output of the toner density sensing means.

4. A device as claimed in claim 3, wherein said control means automatically disables the image forming apparatus when both said toner density sensing means and said image density sensing means fail.

5. A device as claimed in claim 4, further comprising display means for displaying the failure.

6. A toner density control device for an image forming apparatus in which developing means develops an electrostatic latent image on an image carrier by using a developer containing a toner, said device comprising:

at least one toner density sensing means for sensing a density of the toner contained in the developer;

at least one image density sensing means for optically sensing a density of a test pattern image produced by developing a latent image representative of a test pattern by the toner;

toner supplying means for supplying a predetermined amount of toner to the developing means in response to at least one of a toner density and an image density sensed by said toner density sensing means and said image density sensing means, respectively; and control means for controlling said toner supplying means such that when both of said toner density sensing means and said image density sensing means fail, the image forming apparatus is automatically disabled.

7. A device as claimed in claim 6, further comprising display means for displaying the failure.

* * * * *